US005125860A

United States Patent [19]

Tsai

[11] Patent Number: 5,125,860

[45] Date of Patent: Jun. 30, 1992

[54] FLIPPER ASSEMBLY

[76] Inventor: Yen-Wen Tsai, 144, Lane 509, Pei Tun Road, Taichung, Taiwan

[21] Appl. No.: 662,838

[22] Filed: Mar. 1, 1991

[51] Int. Cl.[5] ..... A63B 31/14

[52] U.S. Cl. ..... 441/64

[58] Field of Search ..... 441/64; D21/239; 440/60, 61, 65, 76, 63

[56] References Cited

U.S. PATENT DOCUMENTS

| | | | |
|---|---|---|---|
| 3,952,351 | 4/1976 | Gisbert | 441/64 |
| 4,017,925 | 4/1977 | Shamlian | 441/64 |
| 4,599,071 | 7/1986 | Juang | 441/64 |
| 4,787,871 | 11/1988 | Tomlinson | 441/64 |

*Primary Examiner*—Jesus D. Sotelo
*Assistant Examiner*—Stephen P. Avila

[57] ABSTRACT

A flipper assembly comprises a rectangular, grid-shaped frame with a plurality of longitudinal strips spacedly disposed therein, a plurality of danglable leaves, and a plurality of transverse crossbars. Each of the crossbar is disposed under the frame spacedly and attached to an upper surface of a leaf respectively. Two pairs of straps are disposed at two opposite sides of the frame respectively. The total weight of the largest sized flipper assembly is only 710 grams. Another flipper assembly comprises a sandal, a rectangular frame with a plurality of longitudinal strips spacedly disposed therein, a plurality of danglable leaves, and a plurality of transverse crossbars. Each of the crossbar is disposed under the frame spacedly and attached to an upper portion of a leaf respectively. A strap is disposed on the upper surface of the sandal.

1 Claim, 2 Drawing Sheets

FLIPPER ASSEMBLY

BACKGROUND OF THE PRESENT INVENTION

The present invention relates to a flipper assembly and more particularly to an improved flipper assembly which can propel the user faster and further than a conventional flipper does.

A conventional flipper is generally formed in one piece without any through hole at all. When the user extends his legs in water, his body will move forwardly. When the user retracts his legs, his body will move backwardly. Thus the forwarded motion and the backward motion will offset each other in every stroke. Therefore, the user has to extend his legs fast and retracts his legs in a different direction and angle in order to move forwardly. However, the forward motion is slowed while his legs are retracted since the backward motion will be presented somewhat.

If a flipper has through holes therein, the backward motion will be slow. However, the forward motion will be slow also. Therefore, a conventional flipper with through holes does not help the user too much.

SUMMARY OF THE PRESENT INVENTION

The main object of the present invention is to provide a flipper assembly so that the user can move forwardly very fast in water.

Another object of the present invention is to provide a flipper assembly so that the user can swim or dive with little force of legs.

Accordingly, the flipper assembly is used for both dive and swim. A plurality of plate-shaped leaves are attached to a flat frame securely. The first preferred embodiment discloses a sandal-shaped flipper assembly comprising a sandal with two bars extending forwardly, a frame disposed between the two bars, and a plurality of plate-shaped leaves attached under the frame disclosed a grid-shaped flipper assembly comprising a flat straps at two opposite sides and a pair of straps at another side of the frame for binding a user's foot. Thus an upper portion of the frame is a footwear portion. The total weight of the largest sized flipper assembly is only 710 grams. When the user extends his legs in water, the plate-shaped leaves will be approximately parallel to the surface of the frame in order to block water from flowing through the frame so that the user can move forwardly very fast. When the user retracts his legs in water, the plate-shaped leaves will be approximately perpendicular to the surface of the frame in order to allow water flowing through the frame easily so that the user will move backwardly very slow even if the user retracts his legs in the opposite direction of the forward motion. Because the plate-shaped leaves are danglable, the plate-shaped leaves allow water flowing through the frame while the user retracts his legs and the plate-shaped leaves block water from flowing through the frame while the user extends his legs. The synergistic functions of the flipper assemblies of the present invention are superior to those of conventional flippers. Therefore, the features of the present invention are novel and non-obvious.

DESCRIPTION OF THE PREFERRED EMBODIMENT

Figure 1:
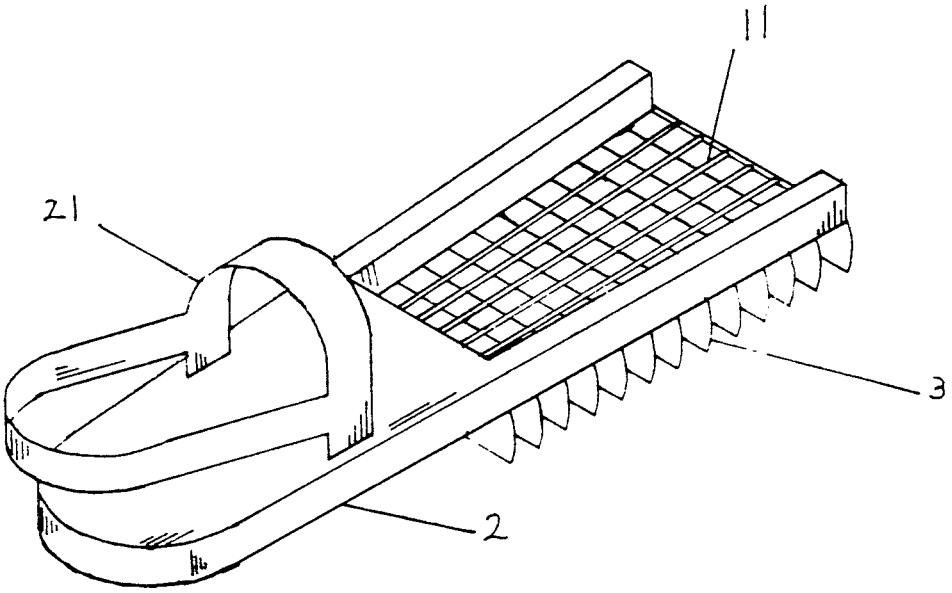
FIG. 1 is a perspective view of a flipper assembly of a preferred embodiment in accordance with the present invention.
Figure 2:
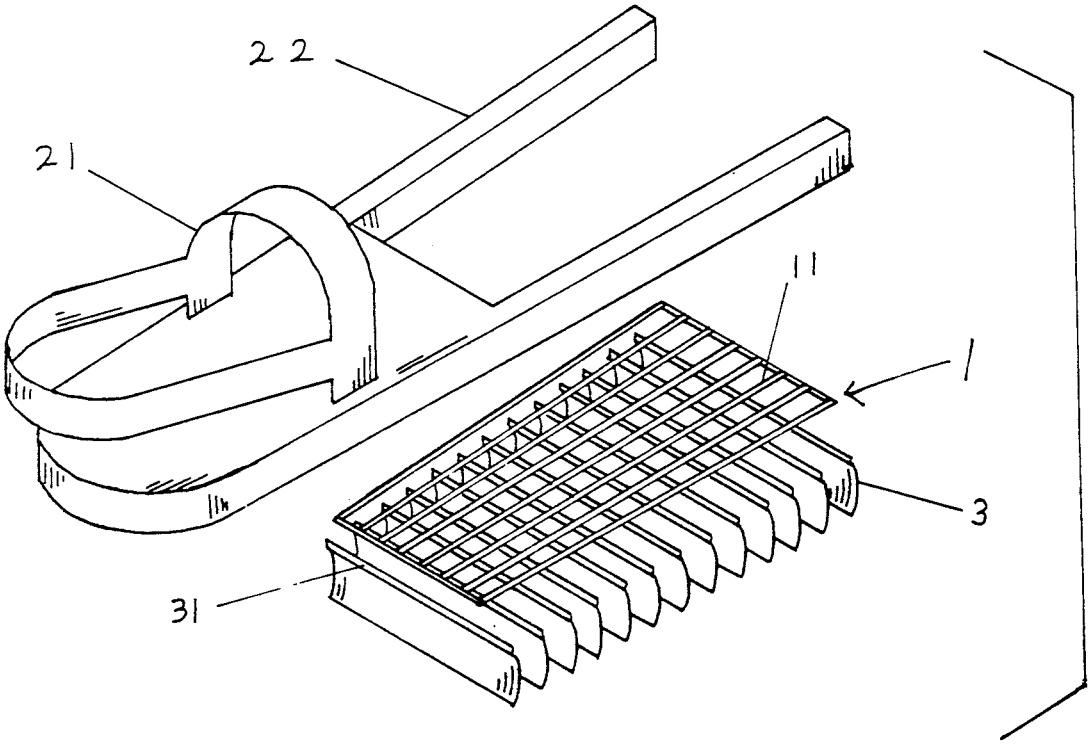
FIG. 2 is an exploded view of FIG. 2.
Figure 3:
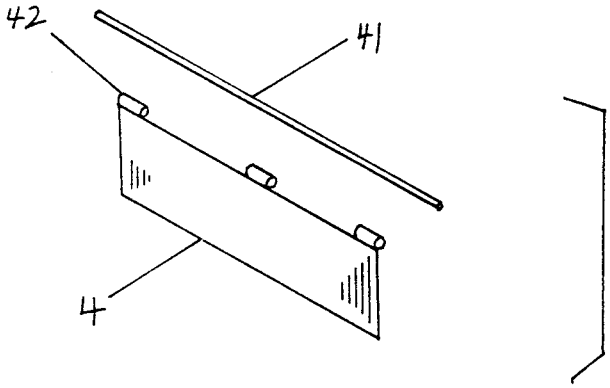
FIG. 3 is an exploded view of a transverse crossbar and a plate-shaped leaf illustrating an attachment of the crossbar and the plate-shaped leaf in FIG. 1.

Referring to FIGS. 1 and 2, a sandal-shaped flipper assembly comprises a rectangular frame 1, a sandal 2, and a plurality of plate-shaped leaves 3. A strap 21 is disposed on the upper surface of the sandal 2. The sandal 2 has two bars 22 extending forwardly. The flat frame 1 which has a plurality of elongated strips 11 spacedly and longitudinally disposed therein is disposed between the two bars 22. A plurality of leaves such as plate-shaped leaves 3 are attached under the frame 1 spacedly. The plate-shaped leaves 3 are disposed transversely and downwardly against the frame 1. One example is that each transverse crossbar 31 under the frame 1 spacedly and transversely is adhered to the upper portion of a soft, plate-shaped leaf 3 respectively. Referring to FIG. 3, another example is that three rings 42 attached on the top of a plate-shaped leaf 4 spacedly are passed through by the crossbar 41. The leaf 4 is suspended.

Figure 5:
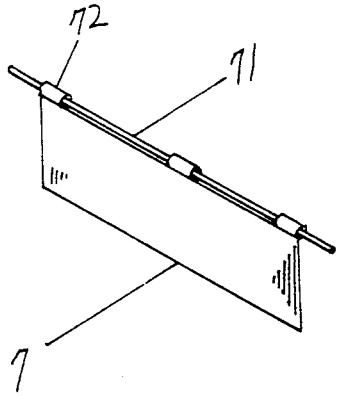
FIG. 5 is a perspective view of a transverse crossbar and a plate-shaped leaf illustrating an attachment of a crossbar and a plate-shaped leave in FIG. 4.
Figure 4:
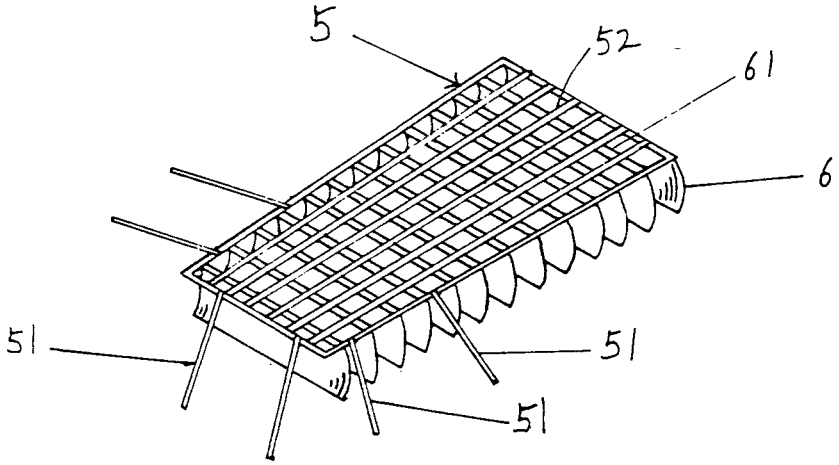
FIG. 4 is a perspective view of a flipper assembly of another preferred embodiment in accordance with the present invention.

Referring to FIG. 4, a grid-shaped flipper assembly comprises a rectangular frame 5, two pairs of straps 51 at two opposite sides and a pair of straps 51 at another side of the frame 5 for binding a user's foot, and a plurality of plate-shaped leaves 6. The flat frame 5 which defines a grid-shaped net has a plurality of elongated strips 52 spacedly and longitudinally disposed therein. A plurality of leaves such as plate-shaped leaves 6 are attached under the frame 5 spacedly. The plate-shaped leaves 6 are disposed transversely and downwardly against the frame 5. One example is that each transverse crossbar 61 under the frame 5 spacedly is adhered to the upper portion of a soft, plate-shaped leaf 6 respectively. Referring to FIG. 5, another example is that three rings 72 attached on the top of a plate-shaped leaf 7 spacedly are passed through by the crossbar 71. The leaf 7 is suspended. The leaves 6 and 7 are bent, then crumpled and then squashed while the flipper assembly is treaded by a user, and the original shapes of the leaves 6 and 7 are recovered while the leaves 6 and 7 are suspended in the air. The transverse crossbars 61 and the longitudinal strips 52 form a grid-shaped net. Thus an upper portion of the grid-shaped net is a footwear portion. The total weight of the largest sized flipper assembly is only 710 grams.

Accordingly, the present invention discloses two different kinds of flipper assemblies. The first embodiment disposes the sandal-shaped flipper assembly as shown in FIG. 1. The second embodiment discloses the frame-shaped flipper assembly as shown in FIG. 4. These two embodiments have similar functions and results. Even if a user cannot swim, the flipper assemblies of the present invention can help a portion of the user's body to float on water as long as the user extends and retracts his legs intermittently while he wears the flipper assembly. When the user extends his legs in water, the plate-shaped leaves will dangle to be approximately parallel to the surface of the frame in order to block water from flowing through the frame so that the user can move forwardly very fast. When the user retracted his legs in water, the plate-shaped leaves will dangle to be approximately perpendicular to the surface of the frame in order to allow water flowing through the frame easily so that the user will move backwardly very slow. Since the plate-shaped leaves are danglable, the plate-shaped leaves can dangle corresponding to the direction of water flow. The plate-shaped leaves allow water flowing through the frame while the user retracts his legs, and the plate-shaped leaves block water from flowing through the frame while the user extends his legs. The principles of active force and reactive force are also applied in the present invention. When the water flow is blocked by the plate-shaped leaves, the drag area is large so that the reactive force is large enough to propel the user forwardly fast. When the water flow is passed through the frame and the plate-shaped leaves, the drag area is very small so that the reactive force is small in order to move the user backwardly very slow. Therefore, the user who wears the flipper assembly can swim or dive very well with very little experience. Furthermore, the synergistic functions of the flipper assemblies of the present invention are superior to those of conventional flippers. Therefore, the features of the present invention are novel and non-obvious. The longitudinal strips are used for blocking the leaves from dangling over the upper surface of the frame. Furthermore, the flipper assembly without the sandal is superior to the flipper assembly with the sandal. The flipper assembly without sandal has alight weight, so the user who wears the flipper assembly can swim further and farther.

I claim:

1. A flipper assembly comprising:

a sandal with a foot receiving portion and two forwardly extending parallel bars, said foot receiving portion including at least one foot retaining strap, said bars defining a central opening;

a flat frame having a plurality of longitudinal members and being mounted to and extending below the bars;

a plurality of transverse crossbars mounted to and extending below the frame such that the crossbars and the frame form an open grid pattern; and, a plurality of transverse leaves being suspended from the crossbars such that the leaves are firm enough to provide a propulsive surface for swimming yet pliable enough to collapse to allow walking on land.

* * * * *